US011807418B2

(12) United States Patent
Siskindovich et al.

(10) Patent No.: US 11,807,418 B2
(45) Date of Patent: Nov. 7, 2023

(54) FOOD DISPLAY, TRANSPORT, STORAGE, AND SERVING SYSTEM

(71) Applicant: Sabert Corporation, Sayrevillle, NJ (US)

(72) Inventors: Yohanan Siskindovich, Glen Ridge, NJ (US); Sarah Ovsiew, Springfield, NJ (US)

(73) Assignee: SABERT CORPORATION, Sayreville, NJ (US)

( * ) Notice: Subject to any disclaimer, the term of this patent is extended or adjusted under 35 U.S.C. 154(b) by 12 days.

(21) Appl. No.: 16/024,261

(22) Filed: Jun. 29, 2018

(65) Prior Publication Data

US 2019/0002159 A1 Jan. 3, 2019

Related U.S. Application Data

(60) Provisional application No. 62/527,509, filed on Jun. 30, 2017.

(51) Int. Cl.

| | |
|---|---|
| ***B65D 21/02*** | (2006.01) |
| ***B65D 25/04*** | (2006.01) |
| ***B65D 43/02*** | (2006.01) |
| ***B65D 77/04*** | (2006.01) |
| ***B65D 1/36*** | (2006.01) |

(52) U.S. Cl.

CPC ..... *B65D 21/0238* (2013.01); *B65D 1/36* (2013.01); *B65D 25/04* (2013.01); *B65D 43/0222* (2013.01); *B65D 77/046* (2013.01)

(58) Field of Classification Search

CPC .... A47G 23/06; A47G 23/0633; A47G 23/08; B65D 21/0238; B65D 1/36; B65D 25/04; B65D 43/0222; B65D 77/046

USPC ..... 220/62.13, 23.86, 915.2, 23.83, 556; 206/514, 515, 518, 519

See application file for complete search history.

(56) References Cited

U.S. PATENT DOCUMENTS

| | | | | |
|---|---|---|---|---|
| 1,919,765 A | | 7/1933 | Barnes | |
| 2,352,684 A | * | 7/1944 | Braddock | A47G 23/06 220/23.6 |
| 2,575,770 A | * | 11/1951 | Roop | B65D 77/0486 220/23.88 |
| 3,756,462 A | * | 9/1973 | Cain | A47G 19/30 220/23.83 |
| 5,894,944 A | | 4/1999 | Swift | |

(Continued)

FOREIGN PATENT DOCUMENTS

| | | |
|---|---|---|
| CA | 2 692 659 | 8/2010 |
| FR | 2 028 868 | 10/1970 |

OTHER PUBLICATIONS

Https://www.wayfair.com/kitchen-tabletop/pdp/prodyne-appetizers-on-ice-with-lids-keeps-acrylic-tray-pyn1039.html pp. 1-6.

(Continued)

*Primary Examiner* — Jeffrey R Allen

(74) *Attorney, Agent, or Firm* — Cozen O'Connor

(57) ABSTRACT

A system for displaying, transporting, storing, and serving food that includes stackable catering platters, containers, and covers. The system provides a modular catering platter system for use in both hot and cold food applications, even at the same time. At least two stackable sectional platters are provided including a larger sectional base and a smaller top section that stackably mate directly with each other.

13 Claims, 16 Drawing Sheets

(56) References Cited

U.S. PATENT DOCUMENTS

| | | | | |
|---|---|---|---|---|
| 6,446,828 | B1 * | 9/2002 | Casteel | A47G 19/065 220/23.83 |
| D526,161 | S * | 8/2006 | Roth | D7/540 |
| 7,871,653 | B2 | 1/2011 | Lin | |
| 7,934,449 | B2 * | 5/2011 | Anderson | B65D 1/36 206/508 |
| 9,265,370 | B2 * | 2/2016 | Kellow, Jr. | A47G 19/065 |
| 2003/0129284 | A1 * | 7/2003 | Leuenberger | A47G 19/02 426/129 |
| 2005/0072711 | A1 * | 4/2005 | Yang | A47G 23/08 206/545 |
| 2008/0160143 | A1 * | 7/2008 | Edwards | B65D 1/34 426/129 |
| 2009/0191317 | A1 * | 7/2009 | Lin | A47G 19/02 426/119 |
| 2009/0194543 | A1 * | 8/2009 | Farmer | B65D 1/36 220/575 |
| 2009/0200701 | A1 * | 8/2009 | Kovacevich | A47G 23/06 264/250 |
| 2012/0234838 | A1 * | 9/2012 | Cheng | A47G 19/027 220/575 |

OTHER PUBLICATIONS

Http://nickisrandommusings.com/get-ready-tailgating-rubbermaid-products/ pp. 1-19.
Https://www.hubert.com/product/781012/Nova-Swirl-and-Black-Marble-Party-Tray-Clear-Dome-Lid pp. 1-4.
Https://www.target.com/p/3-tiered-serving-tower/-/A-13541448 pp. 1-5.

* cited by examiner

FOOD DISPLAY, TRANSPORT, STORAGE, AND SERVING SYSTEM

RELATED APPLICATIONS

This application claims priority from U.S. Provisional Patent Application Ser. No. 62/527,509 which was filed on Jun. 30, 2017.

BACKGROUND OF THE INVENTION

1. Field of the Invention

The present invention is directed to a disposable system for displaying, transporting, storing and serving food.

2. Description of the Related Art

Conventionally, when food is to be presented, for example in a catering and/or party situation, in which different types of food may be served, the individual containers for each food, and for dips, sauces, etc., are set out side by side, i.e., so as to take up a large area surface of the table or counter on which the food is to be displayed/served. Using separate containers for food transport and presentation is inconvenient because they usually require separate containers, more space and bags for transport, and in addition, an aesthetically pleasing food presentation requires food be removed from the transport containers and rearranged onto other serving dishes such as platters, and the like.

Moreover, in a shopping environment, such as grocery stores, supermarkets and the like, the maximization of available display space, e.g., refrigerator and freezer display cases as well as floor space, is always a concern. It is therefore desirable to efficiently use such space. The use of separate food containers is counterproductive to such concerns.

In addition to the difficulty in moving the various food items and condiments from the transport container to the serving dishes, there is also the problem of storing leftovers. Conventionally, because serving trays are usually not appropriate for long term storage in a refrigerator, leftover food had to be taken out of the serving trays, and placed in sealable containers for storage. Moreover, because different types of food, and in particular dips and sauces, need to be stored separately from one another, storing leftover food requires a different sealable container for each item of the food and associated dips and sauces. All of the separate storage containers take up a large amount of storage space.

There is therefore a need for a system that can function to transport and present food, and can also be used to store the food, with each item of food being separated and yet without the need for multiple, separate, storage tubs.

SUMMARY OF THE INVENTION

The present invention is directed to a system for displaying, transporting, storing, and serving food that includes stackable platters, containers, and covers. The system according to the present invention provides a modular catering platter system for use in both hot and cold food applications, even at the same time. The system includes at least two stackable sectional platters, which can include a larger sectional base and a smaller bowl section, and a lidding option. The bowl section is also adapted to seat a smaller resealable tub, providing further flexibility is presentation and food storage. Each of the base section, bowl section, and tub also can have its own respective cover. The vertical configuration of the system occupies less horizontal space in display cases, transport and take-out vehicles, tabletops, and the like—as compared to the use of side-by-side compartmented or separate containers—which yields a more-efficient use of such space.

When stacked, the sectional base and the sectional bowl create a tiered catering platter that increases food offering and elevates overall platter presentation, thereby minimizing the overall horizontal "footprint" in a display case and tabletop. Although stackable with respect to one another for use as a 2-platter, 2-level system, each of the sectional platters can also be used separately, e.g., side-by-side. This offers operators of the system a great amount of menu flexibility and presentation options.

Stackability of the disclosed system is provided, at least in part, by structural elements of the upper and lower trays, for example, by the shape of the central receiver compartment and a corresponding shape of a bottom of the upper tray. The respective shapes allow attached trays to be maintained at a vertical distance from one another, without the need for either a connector plate or an additional tower structure. The present invention provides for the use of each of the trays at the same time, whether stacked or not.

According to one aspect of the invention, the polygonal, preferably rectangular shape, of the central structures in each of the upper and lower trays eliminate the ability of the trays to twist unintentionally with respect to one another. According to one aspect of the invention, the central structure can be circular or oval. For a circular central structure a key or other structural element can be included to prevent unwanted turning.

According to one aspect of the invention, radial ribs define serving compartments, which, due to a space between adjacent ribs, provides separation between compartments in the level in which the ribs are arranged. These radial ribs are also providing strength and structural integrity to the system, and ensure the assembled components are robust and can endure transport and handling.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
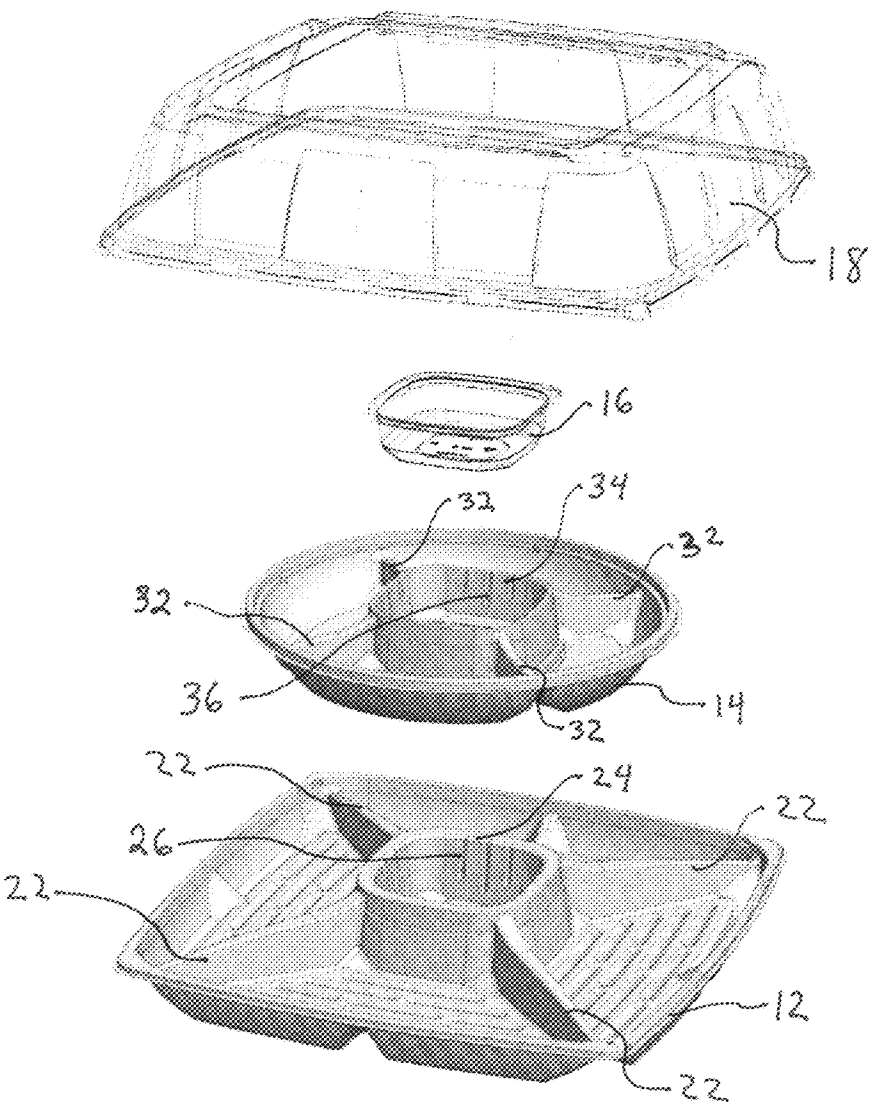
FIG. 1 is an exploded view showing the sectional base, smaller bowl, a tub and a upper lid.

With reference to FIG. 1, the system 10 of the present invention includes a sectional base 12, a sectional bowl 14, a tub 16, and a large lid 18. The large lid 18 is configured to sealingly mate with the edges of the sectional base 12, and may cover only the sectional base 12, or may cover the sectional base 12 and the sectional bowl 14 and the tub 16. While disclosed as a bowl 14, the tiered components can be flat sectioned platters, bowls, or the like. That is to say, the large lid 18 is configured with sufficient clearance to cover all of the components of the assembled system 10, although it need not be used in this manner. In one embodiment, the lid 18 is configured to mate with the outer perimeter of the sectional base 12 and the sectional bowl 14. Alternatively, a plurality of lids are provided, one for each of the sectional bowl 14, tub 16, and the large lid 18 for the sectional base 12. The lids are preferably transparent or translucent and preferably constructed of polyethylene terephthalate (PET). The sectional base 12, sectional bowl 14, tub 16, as well as their respective lids are preferably constructed of PET, polypropylene, or polystyrene (PS). Other plastics that can be used include high density polyethylene (HDPE), polyvinyl chloride (PVC), low density polyethylene (LDPE), polypropylene (PP), and the like. The sectional base 12, sectional bowl 14, tub 16, as well as their respective lids are constructed by blow molding, injection molding, stretch molding, compression molding, gas assist molding, film insert molding, rotational molding, thermoforming, and the like.

Figure 2A:
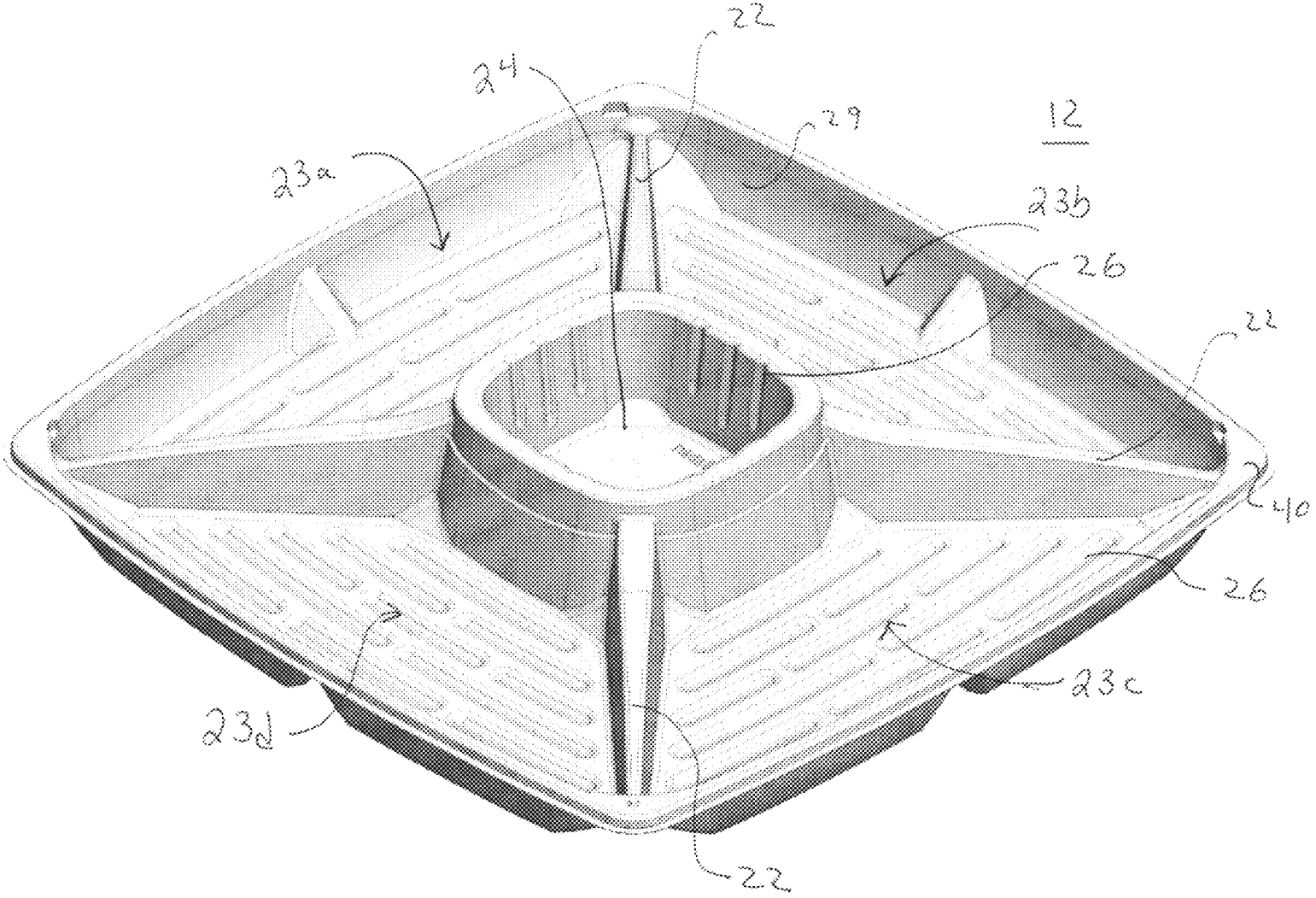
FIGS. 2A, 2B and 2C are perspective, top, and side views, respectively, of the sectional base according to one embodiment of the present invention.
Figure 2C:
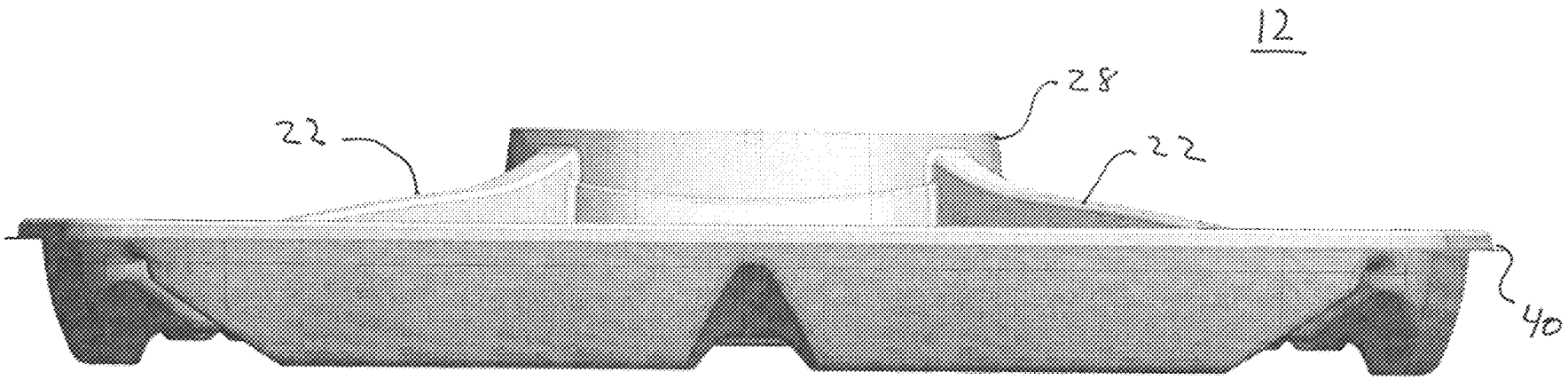
Figure 2B:
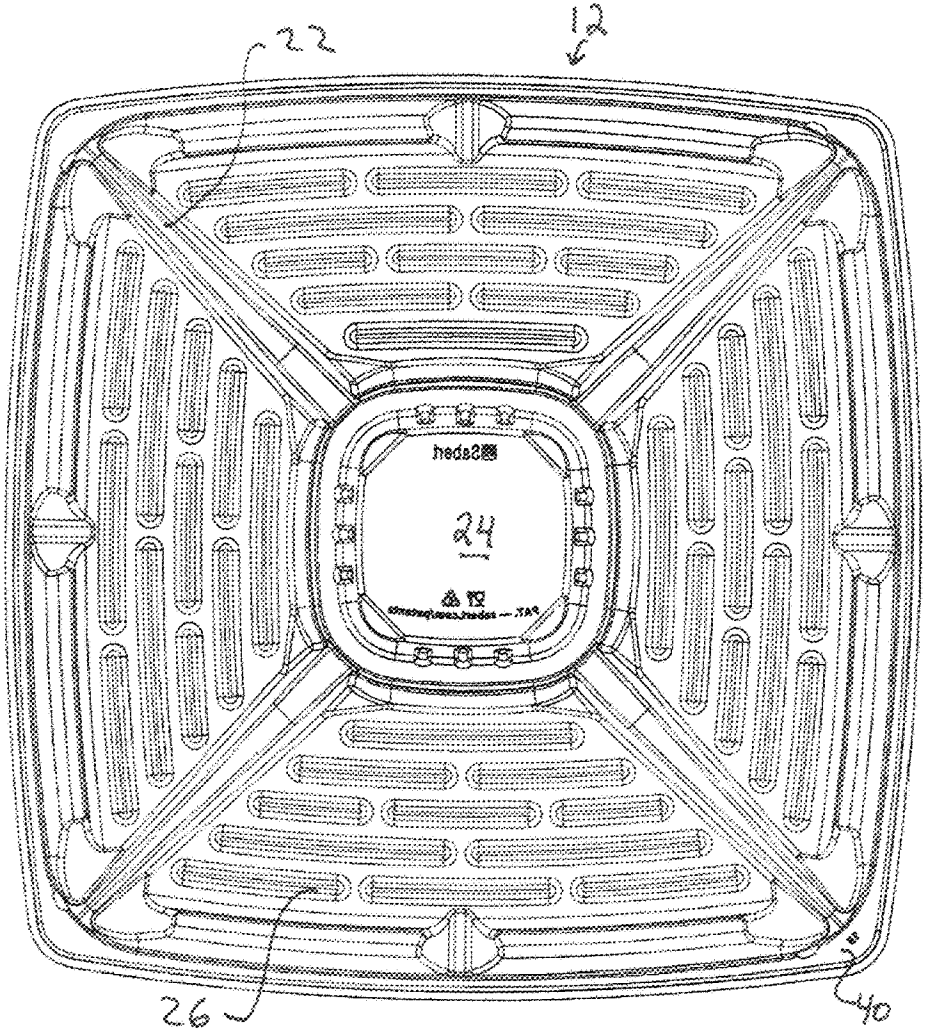

With reference to FIGS. 2A-2C, the sectional base 12 is preferably made of polypropylene and is provided with divided sections. The sectional base 12 is preferably divided into at least three sections via ribs 22. Preferably the sectional base 12 has a sectional 4-compartment ribbed bottom having ribs 22 extending radially from a central receiver/compartment 24, functioning as a fifth compartment, and ending at the respective corners of the base 12. The four ribs 22 and the peripheral edges of the central receiver/compartment 24 define four compartments 23*a*, 23*b*, 23*c* and 23*d* in the ribbed bottom. The central receiver/compartment 24 is preferably substantially rectangular-shaped. In other words, the central receiver/compartment 24 has 2 pairs of parallel walls and rounded corners. In a preferred embodiment, the central receiver/compartment 24 is substantially square. The sectional base 12 is configured so that it can sit on a surface and not rock or tip as food items are added and removed from the compartments.

The floors of the ribbed bottom, in particular the floors of the compartments 23*a*, 23*b*, 23*c* and 23*d*, are preferably formed so as to have a plurality of horizontal grooves 26. Additional vertical grooves are preferably formed in the central receiver 24 to provide structural support. In addition to providing structural support, the horizontal grooves 26 and/or ribs 22 also serve to prevent food in adjacent compartments from comingling, e.g., during movement of the base 12. That is, the horizontal grooves 26 and ribs 22 assist in segregating the different food items from one another.

The central receiver 24 is also configured to facilitate direct mating of the base 12 with a bottom inward protrusion in the bowl 14, to provide stable stackability, and/or to store and/or serve dipping sauces, for example if the base 12 is to be used separately for serving food.

Figure 3B:
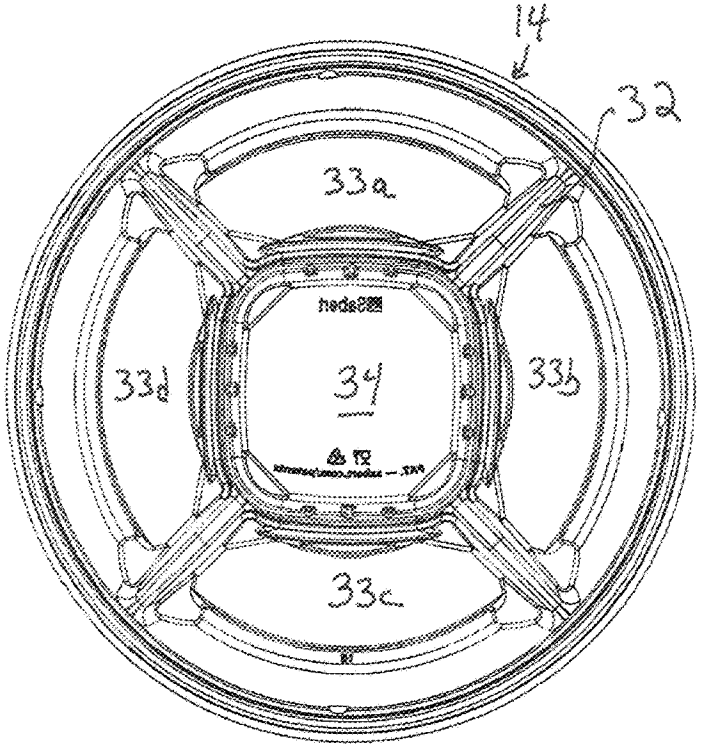
FIGS. 3A, 3B and 3C are perspective, top and side views, respectively, of the sectional bowl according to one embodiment of the present invention.
Figure 3A:
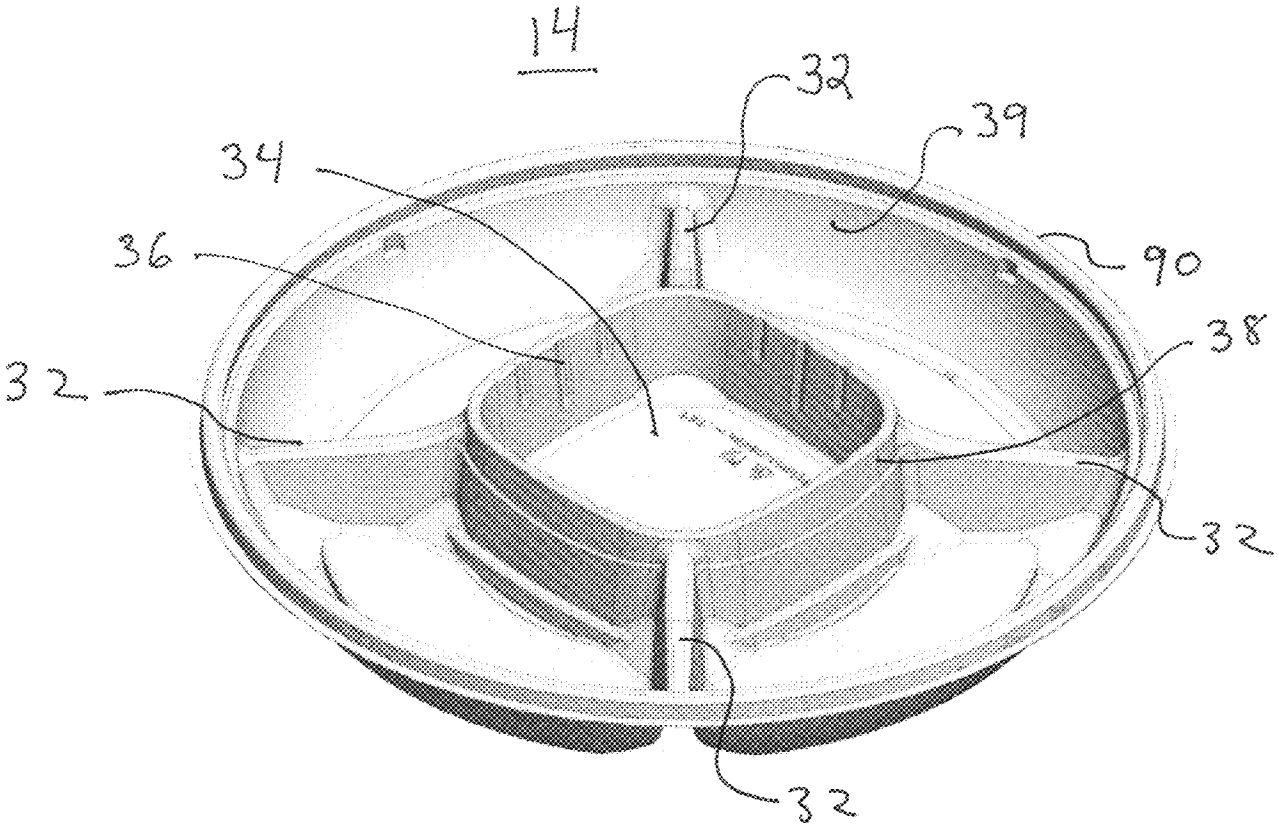
Figure 3C:
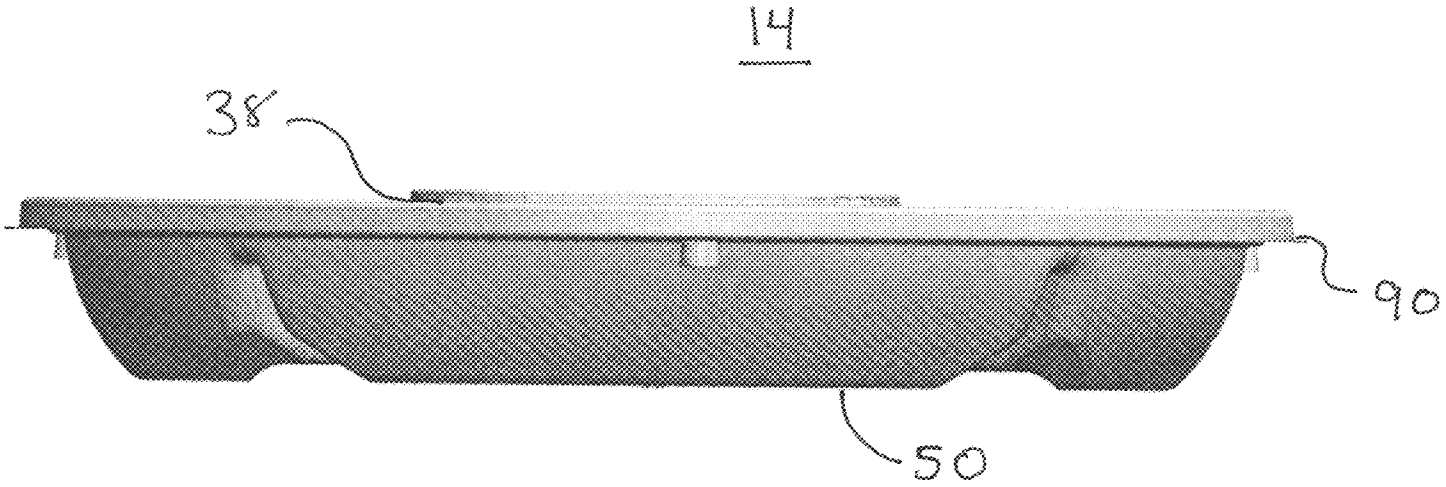

With reference to FIGS. 3A-3C, the sectional bowl 14 is preferably made of Polypropylene and, as shown, preferably has a sectional 4-compartment having ribs 32 extending radially from a central receiver/compartment 34, which functions as a fifth compartment, and ending at the periphery of the bowl 14. The four ribs 32 and the peripheral edges of the central receiver/compartment 34 define four compartments 33*a*, 33*b*, 33*c* and 33*d* in the ribbed bottom. The central receiver 34 can be used to store and/or serve dipping sauces, and/or can be used to mate directly with a bottom convex portion of a tub 16. The central receiver 34 is dimensioned to securely accommodate the tub 16 therein. Preferably the central receiver/compartment 34 is dimensioned to be able to receive a commercially available tub 16 and other tubs of the same footprint and of the product line. Vertical grooves 36 are preferably formed in the central receiver 34 to provide structural support. The base 12 and the bowl 14 are preferably structured to withstand hot food serving applications with temperatures up to 185° F.

The sectional bowl 14 is configured so that when it is not stacked on the sectional base 12 it can be supported on a flat surface so as not to rock or tip as food items are added to, or removed from, the compartments. The base of the bowl 14 is generally planar so that it can stably rest on a surface without additional stabilizing elements.

While the sectional bowl 14 is described as having a sectional 4-compartment ribbed structure, the bowl 14 preferably has at least three sections defined by three ribs 32. According to one aspect of the invention, for configurations in which the base 12 and the bowl 14 are stacked, the ribs 22 of the base 12 and the ribs 32 of the bowl 14 are spaced apart.

According to one aspect of the invention a food storage and display system 10 includes a base tray 12 and a top tray 14.

The base tray 12 has a first base sheet, a first central receiving portion 24 is formed by a wall 28 extending substantially vertically from the first base sheet that defines a first central polygonal cavity. An outer wall 29 extends from the first base sheet at a radially outer portion of the first base sheet and an outer lip 40 is arranged radially beyond the outer wall 29 having a first perimeter. A plurality of first radially extending ribs 22 are arranged between the first central receiving portion 24 and the outer wall 29.

The top tray 14 is configured to stack on the base tray 12 and comprises a second base sheet. A second central receiving portion 34 is formed by a wall 38 extending substantially vertically from the second base sheet that defines a second central polygonal cavity. A top of the first central receiving portion 24 is configured to seat directly in a groove 55 formed by an underside of the second central receiving portion 34 to maintain a vertical distance between a top of the base 12 tray and a bottom 50 of the top tray 14. An outer wall 39 extends from the second base sheet at a radially outer portion of the second base sheet and an outer lip 90 is arranged radially beyond the outer wall 39. The top tray 14 has a second perimeter that is smaller than the first perimeter of the bottom tray 12. A plurality of second radially extending ribs 32 are arranged between the second central receiving portion 34 and the outer wall 39. A top portion of at least a part of each first radially extending rib 22 is configured to seat directly under underside 58 of a corresponding second radially extending rib 32.

According to one aspect of the invention, a first lid 18 is configured to mate with the outer lip 40 of the base tray 12. Preferably, the first lid 18 is polyethylene terephthalate and is transparent or translucent to allow for viewing of the contents of the tray. Alternatively, a second lid 84 is configured to mate with the outer lip 90 of the top tray 14. Preferably, the second lid 84 is also polyethylene terephthalate which is preferably transparent or translucent.

According to one aspect of the invention, the grooves 52, 54, 55, 58 that form the ribs 22, the first central receiving portion 24, the second central receiving portion 34, and the ribs 32, respectively, provide insulation between the respective sections 23*a*-23*d* and 33*a*-33*d* that they create.

Figure 4A:
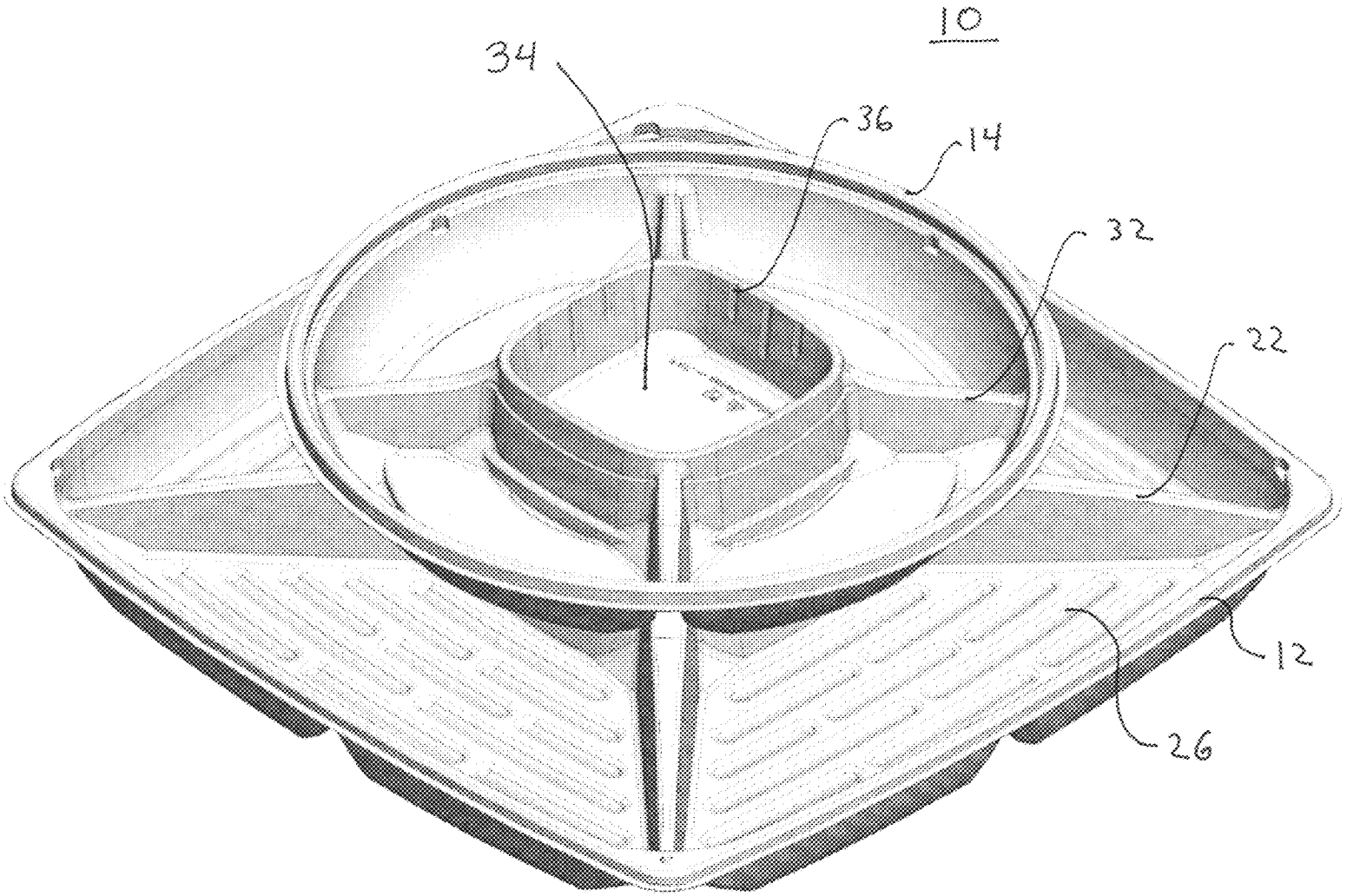
FIGS. 4A, 4B and 4C are perspective, top, and side views, respectively, of the sectional bowl stacked on the sectional base according to one embodiment of the present invention.
Figure 4B:
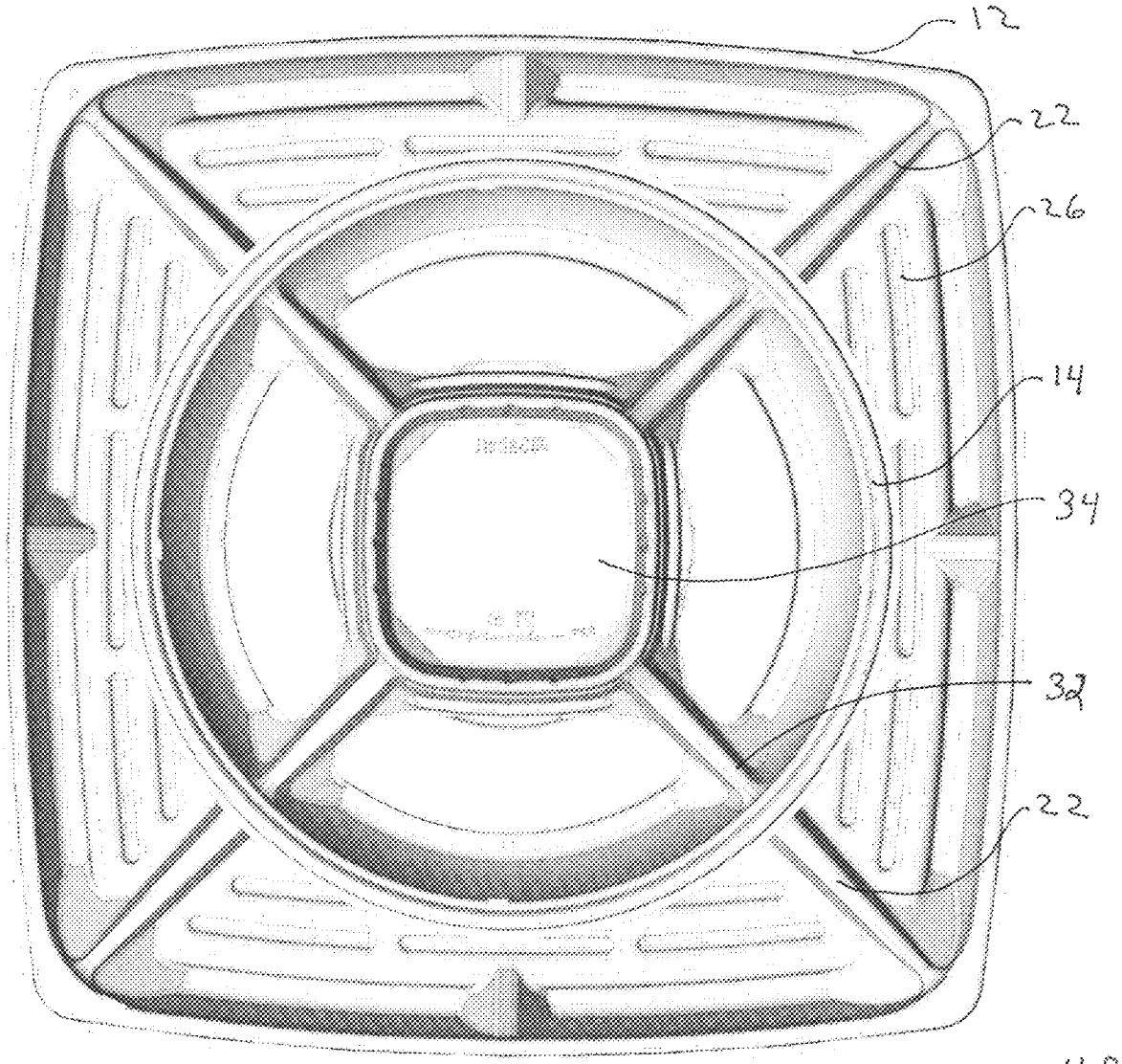
Figure 4C:
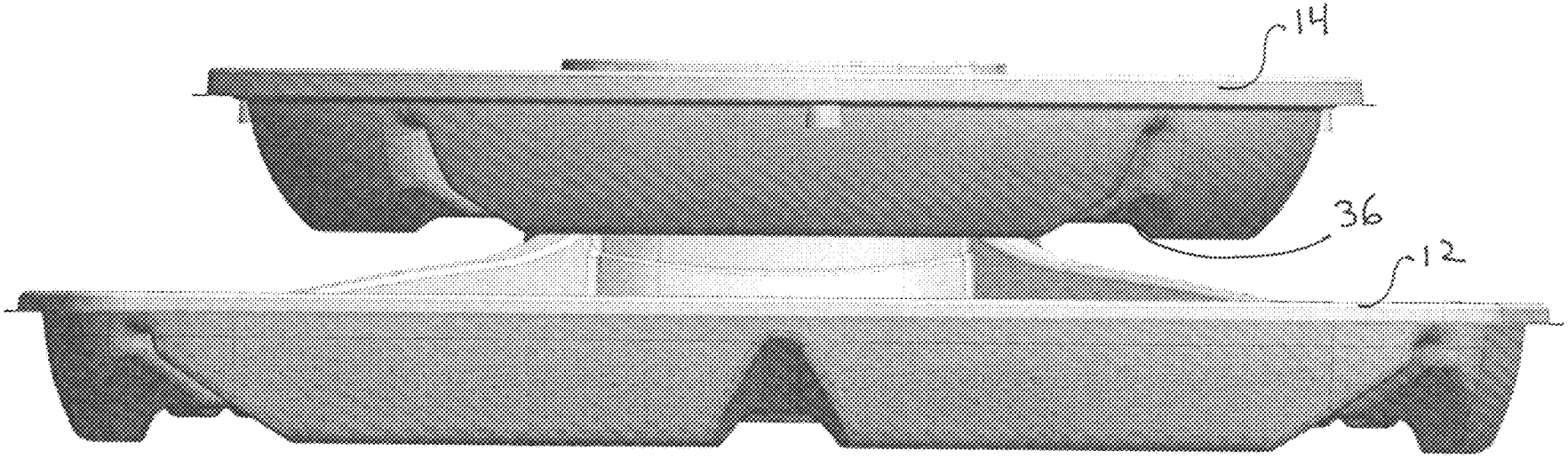

With reference to FIGS. 4A, 4B and 4C, the sectional bowl 14 is configured to vertically stack directly on the sectional base 12 in the manner shown in these figures. The central receiver/compartment 24 of the base 12 has a non-circular, and preferably generally rectangular outline, particularly preferably an outline that is in the shape of a square with rounded corners. The central receiver/compartment 34 of the bowl 14 has preferably the same shaped outline as that of the central receiver/compartment 24 of the base 12. In this way, the bowl 14 can be stacked directly on the base 12 in a rotationally secure, yet easily removable, manner.

The use of a non-circular receiver compartment 24 prevents unwanted rotation of the bowl 14 when it is stacked on the base 12. Also, as can be seen in the figures, the corresponding ribs 22, 32 and receiver/compartments 24, 34 of the base 12 and the bowl 14 are configured to mate such that the ribs 22, 32 of each component 12, 14 line up with those of the other components when stacked together. The ribs 22, 32, divide the platters and add structure.

Additionally, as can be seen particularly in FIGS. 4*a* and 4*c*, the base 12 and the bowl 14 are shaped and dimensioned so that, when stacked together, sufficient food storage space is provided in the compartments 23*a*, 23*b*, 23*c* and 23*d* of the base 12. This is achieved, for example, by shaping the underside of the bowl 14 so that the top rim of the receiver/compartment 24 of the base 12 does not penetrate too deeply into the bowl 14 when the base 12 and bowl 14 are stacked together, allowing the bowl 14 to sit relatively high in relation to the base 12, leaving sufficient space, in the vertical direction, in the compartments 23*a*, 23*b*, 23*c* and 23*d* of the base 12 to store and access food, without the food touching the bottom of the bowl 14.

Figure 5A:
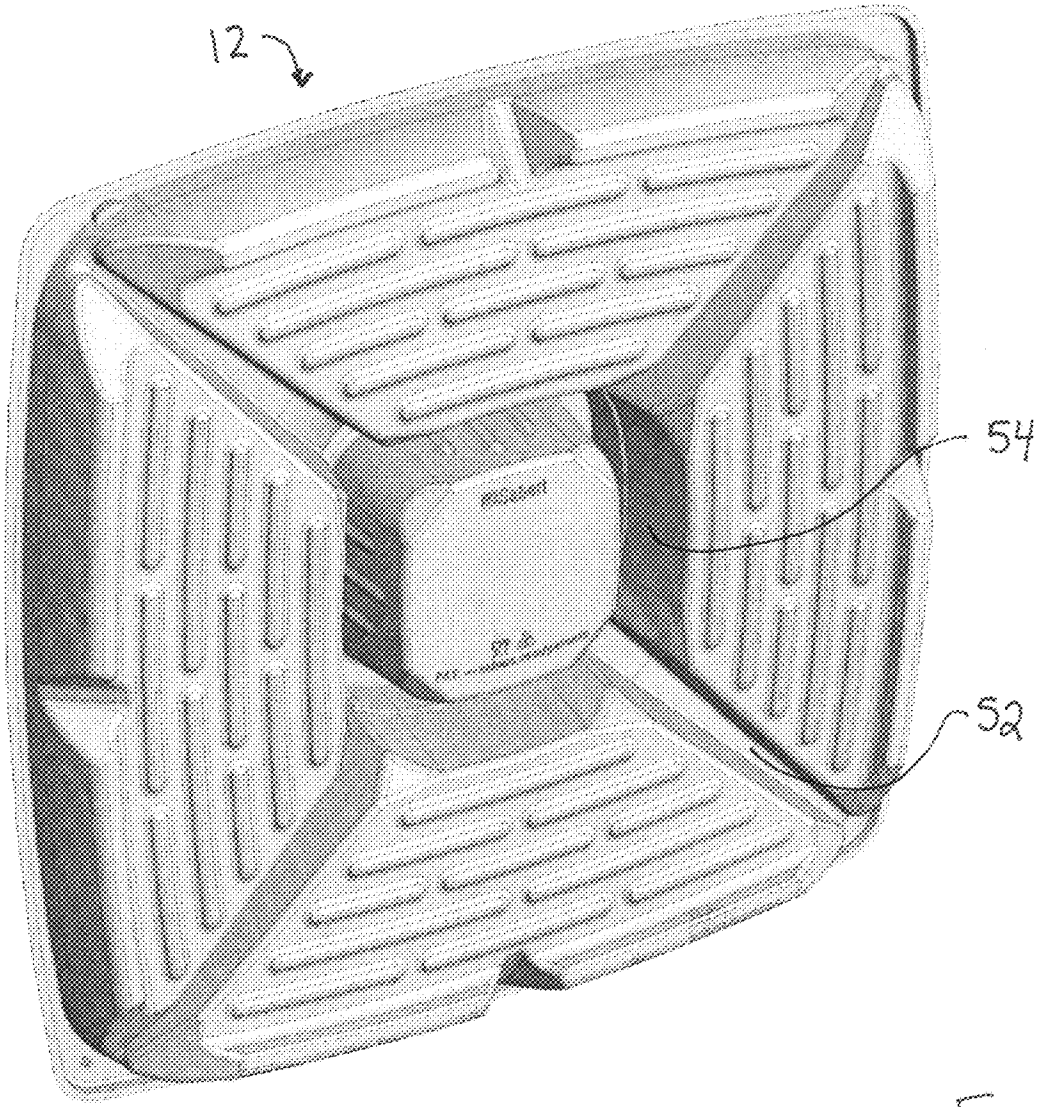
FIGS. 5A and 5B show underside views of the sectional base and the sectional bowl.
Figure 5B:
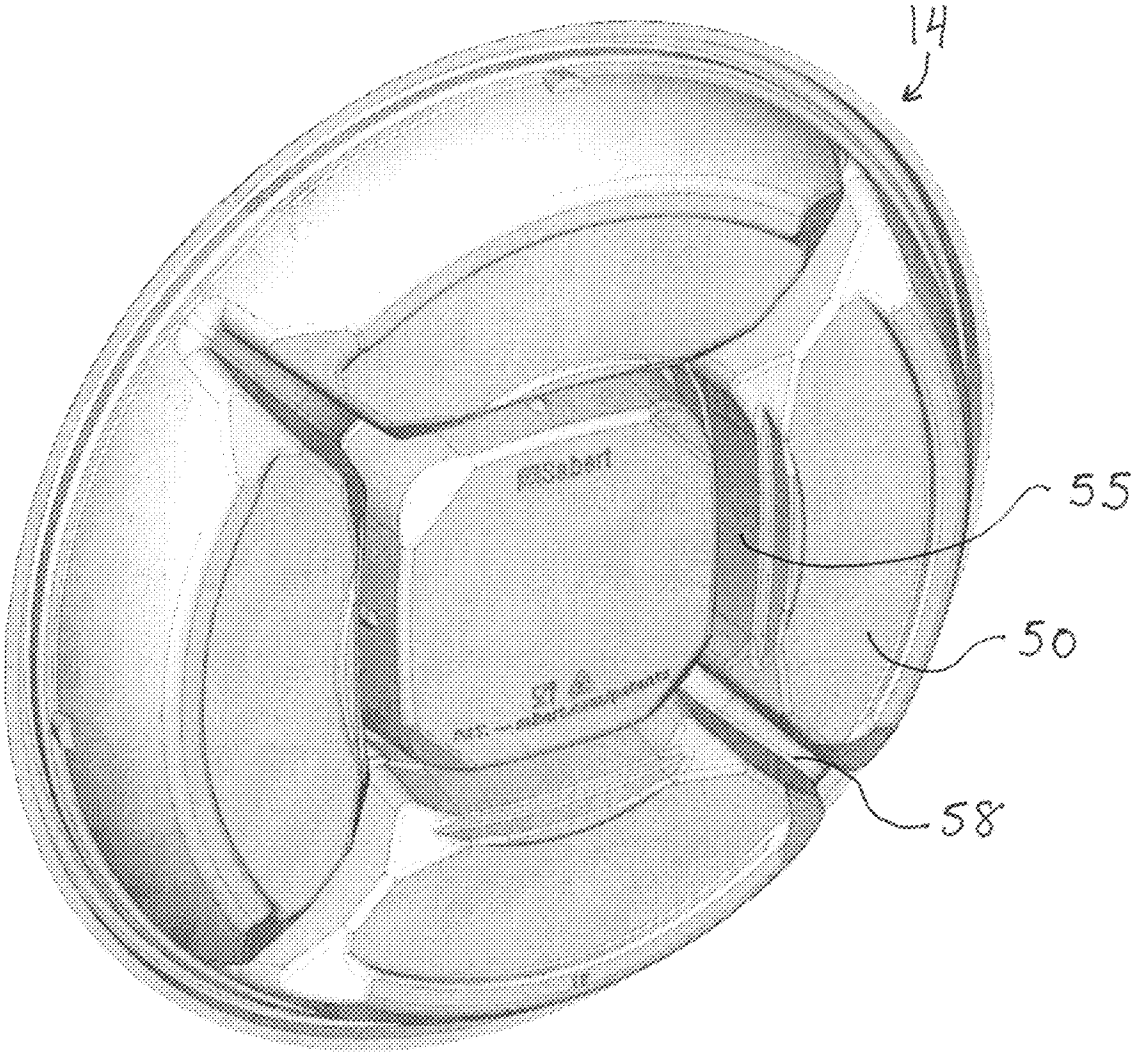

FIG. 5A shows a bottom view of the base 12 and FIG. 5B shows a bottom view of the bowl 14, on the right of the figure. The bowl 14 has, on its underside, a generally rectangular (i.e., with rounded edges) groove 55 that is formed in the molding of the bowl's central receiver/compartment 34. When the base 12 and the bowl 14 are stacked, the top rim of the central receiver/compartment 24 of the base 12 nests directly in the groove 55 of the bowl 14. As shown, the bottom of the bowl 14 is substantially planar. The planar aspect of the base of the bowl 14 allows the bowl 14 to be used in an unstacked manner without tipping or rocking, which would be caused by a non-planar bottom. Thus, the bowl 14 is stable when used alone, as is the base 12.

The stacked configuration would typically be used either in transportation of food, or storage of the food. However, given the accessibility to the storage compartments 23*a*. 23*b*, 23*c*, and 23*d* when in the stacked configuration, the stacked configuration can also be used for serving. Unstacking at least some of the components can provide a convenient and aesthetically pleasing serving configuration. For example, in FIG. 6, the bowl 14 has been unstacked from the base 12. Food items 65-68 are arranged in the compartments 23*a*, 23*b*, 23*c* and 23*d*. In this case, since the central receiver 24 has been functioning (in the stacked mode) as a pedestal of sorts to support the bowl 14, no content is located in the receiver 24. However, there is nothing to prevent sauce or dip from being added to the receiver 24 after un-stacking of the base 12 and bowl 14, or even store some condiment packets for example in receiver 24 in the assembled state since there is some available space between the bottom of central receiver/compartment 34 and the bottom of receiver 24. Alternatively sauce or dip can be stored in the removable tub 16 arranged in the receiver 24.

Figure 6:
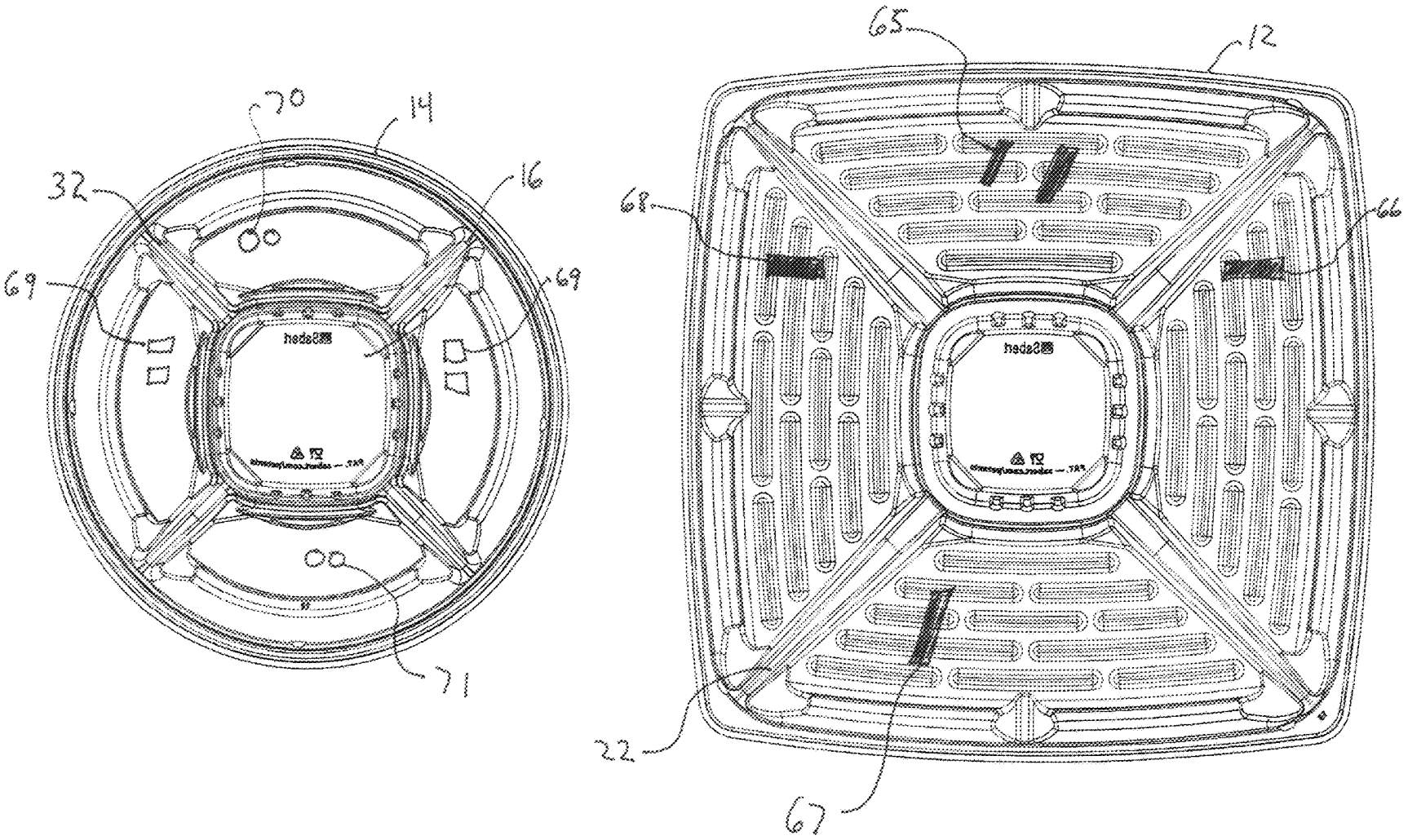
FIG. 6 is a view showing food being presented in the sectional base and the sectional bowl, with the sectional base and the sectional bowl being separated and arranged side by side.

In FIG. 6, the bowl compartments 33*a*, 33*b*, 33*c*, and 33*d* of the bowl 14 contain food items 69, arranged in opposite compartments, and food items 70 and 71, arranged in opposite compartments. In this particular configuration, a condiment, dip, or sauce is stored in a tub 16, which rests in the central receiver/compartment 34. As discussed above, the central receiver/compartment 34 is configured to store sauces or dips without the need for the tub 16. This provides more options to the user for storing, transporting and presenting food. It should be noted that because the ribs 22, 32 are hollow, as shown in FIG. 5, they provide a certain degree of insulation so that neighboring compartments can have different temperature foods. In other words, hot foods, cold foods, and/or room temperature foods can be adjacent to one another.

Figure 7:
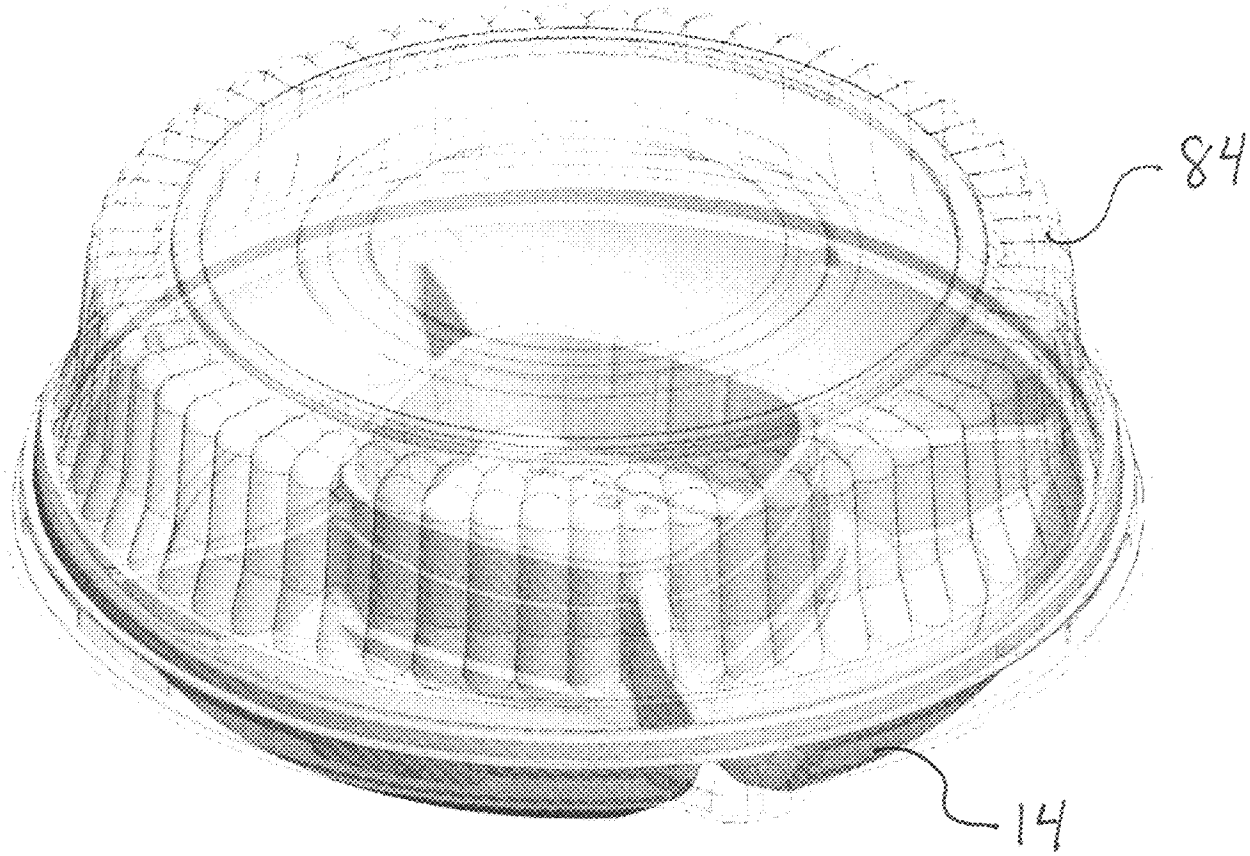
FIG. 7 is a perspective view of the sectional bowl with its lid affixed thereon.

According to one aspect of the invention, as can be seen in FIG. 7, the bowl 14 has its own lid 84, preferably made of PET. The lid 84 would be made of the same material as the lid 18 of the base 12 discussed above, preferably PET. The lid 84 permits separate storage of the items associated with the bowl 14, and, if desired of the tub 16, while providing protection of these items.

Figure 8:
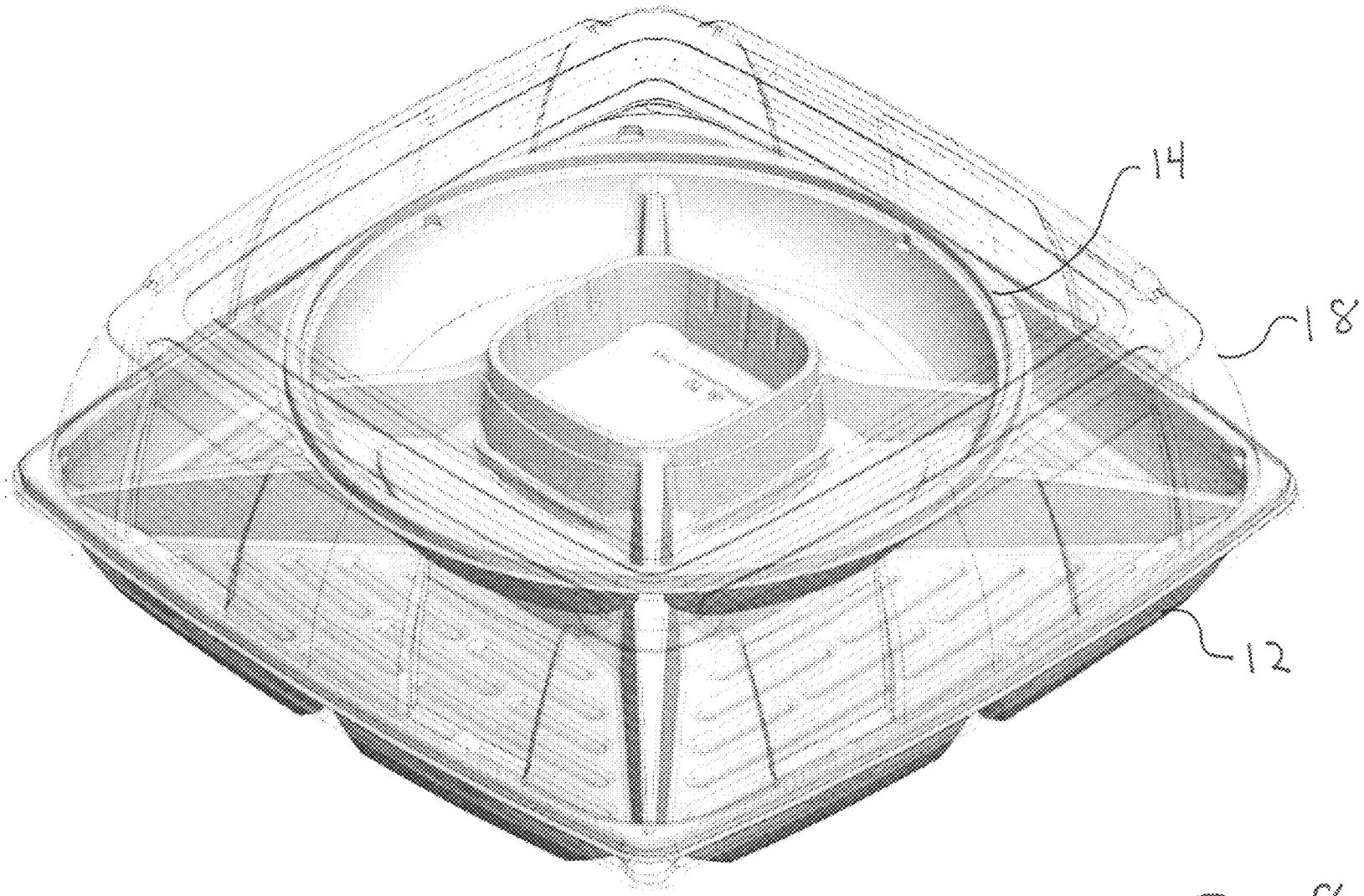
FIG. 8 is a perspective view of the sectional base with its lid affixed thereon.

As discussed above, different combinations of components can be utilized. For example, FIG. 8 shows a base 12 covered by its lid 18. The lid 18 is shaped so that the bowl 14 and the tub 16 can be stored, stacked with the base 12, inside the lid 18.

Figure 9:
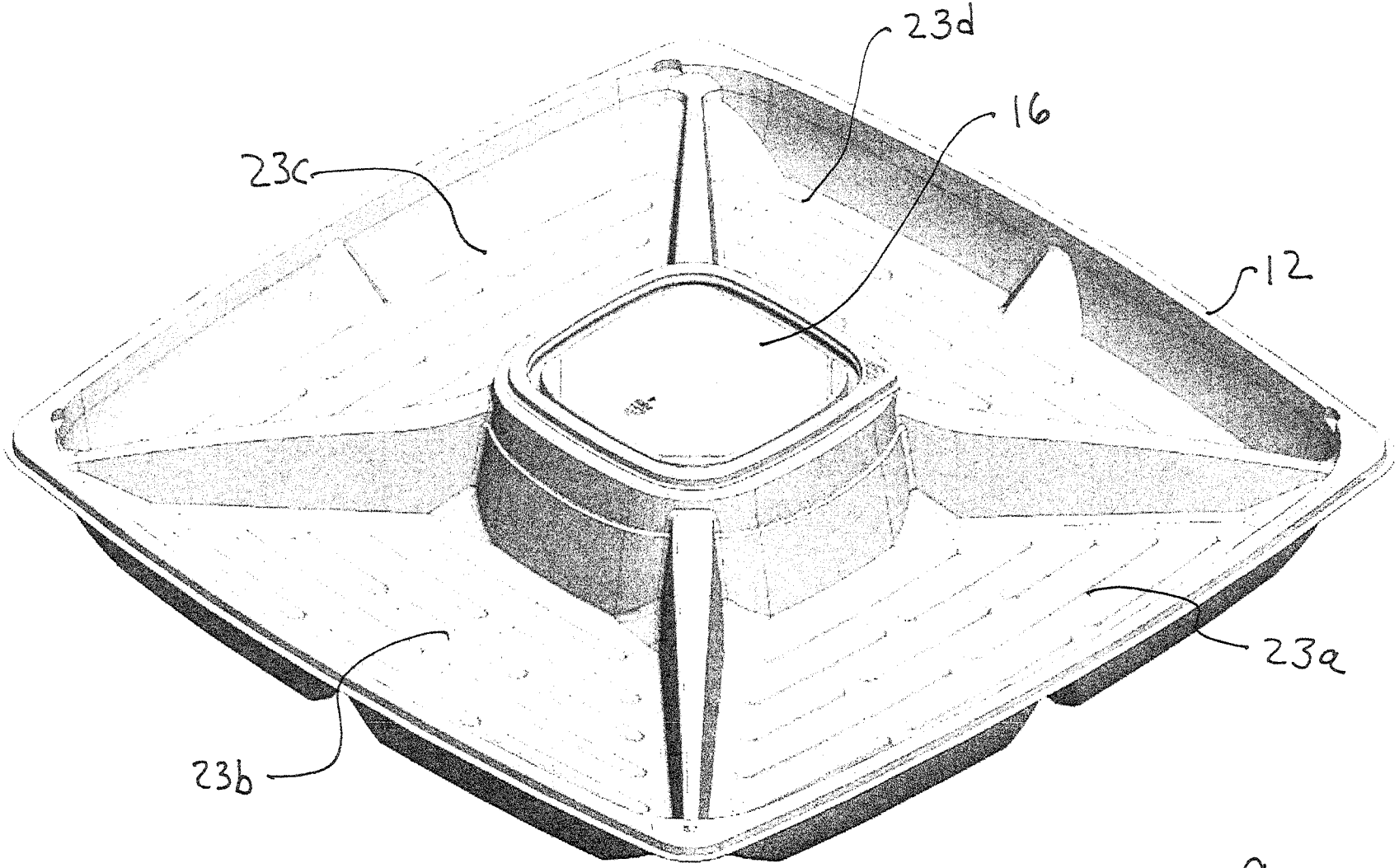
FIG. 9 is a view of the sectional base with food and a lidded tub in its compartments.

FIG. 9 shows a configuration in which the base 12 is used together with the tub 16. In this case, the tub 16, shown with its preferably PET lid on, rests in the central receiver/compartment 24 of the base 12. In the figure, sauce is stored in the tub 16 and various food items are stored in the compartments 23*a*, 23*b*, 23*c* and 23*d*.

Figure 10:
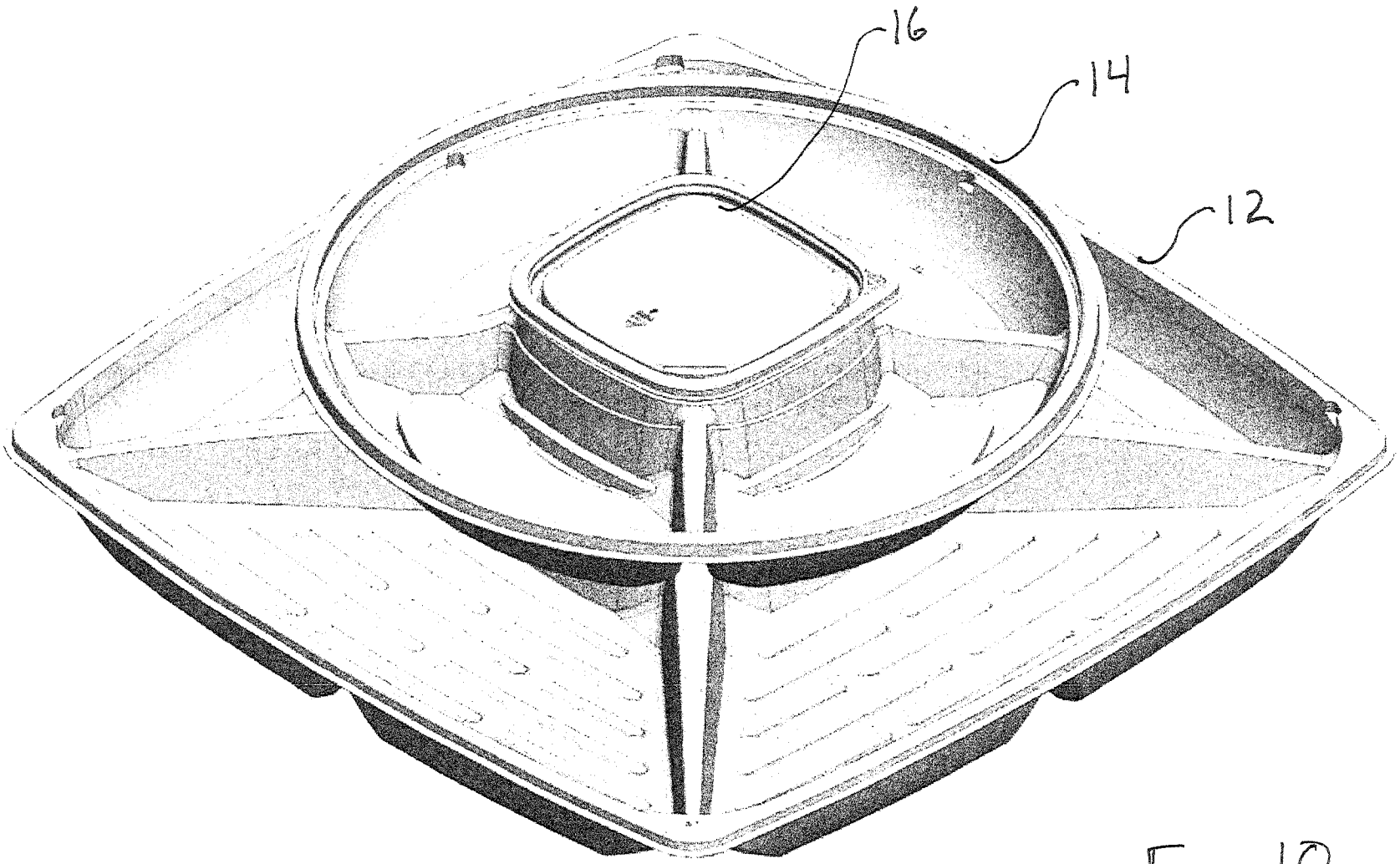
FIG. 10 shows an embodiment of the system of the present invention with the sectional base, sectional bowl and tub stacked for serving food.

FIG. 10 shows the base 12, the bowl 14 and the lidded tub 16 stacked together. As can be seen, the bowl 14 and the base 12 are dimensioned in relation to one another so that the food items in the various compartments can be served in a bi-level configuration. That is, food can be served both from the compartments of the base 12 and the compartments of the bowl 14 simultaneously, while sauce or dip is made available by the tub 16 resting in the receiver/compartment 34 of the bowl 14.

The system 10 discussed above is advantageously configured to display, store, transport and serve food items, due to the various compartments that are isolated from each other. The compartmentalization of the base 12 and bowl 14 function to segregate different food types by keeping apart foods that are not desired to touch one another, such as wet and dry foods. By virtue of the various combinations of components that can be used in the various configurations, platter orders can be highly customized. Moreover, the vertical orientation of the system 10 reduces the size of the overall horizontal "footprint", thereby more efficiently utilizing display case space during merchandising, and tabletop space during serving.

The stackable components are highly versatile, and can be used separately, or together as a two-tier system. Moreover, for convenience both for storage and for carrying, each of the base 12, bowl 14 and tub 16 has its own PET lid, which are preferably transparent or translucent. In addition to the advantages of the system 10 for carrying, serving, and storing food, system 10 also enhances merchandising or presentation display of platters, for example in a grocery or other food store. Moreover, the provision of the central compartments, which have the ability to accommodate a sealable tub 16, allows for storing and serving condiments, dips, and sauces.

According to one aspect of the invention, the PET lids can be vented, and preferably the base 12, bowl 14, tub 16 and corresponding lids are made of recyclable plastic. With the base 12 and the bowl 14 made from durable polypropylene, the unique modular design offers operators unlimited flexibility in menu options serving as the perfect platter for hot and cold food applications.

Further, durable and leak-resistant packaging provided by the system 10 can help grow a catering program and allow operators to integrate one product that addresses multiple food applications and cater to more hot-food specific occasion types.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A food display, transport, storage and serving system comprising:

a base tray comprising:

a thermoformed first base sheet;

a central portion defining a first central cavity having a first central cavity floor and a first central cavity wall extending from the first base sheet;

an outer wall extending from the first base sheet at a distal outer portion of the first base sheet, the outer wall having a first height;

an outer lip arranged beyond the outer wall having a first perimeter; and a plurality of first ribs arranged between the central portion and the outer wall to form a food compartment of the base tray between each of the first ribs; and a top tray configured to stack on the base tray, comprising:

a thermoformed second base sheet;

a central receiving portion defining a second central cavity having a second central cavity floor and a second central cavity wall extending from the second base sheet, wherein a top of the central portion is configured to seat directly in a groove formed by an underside of the central receiving portion to vertically position the second central cavity floor at a second height which is greater than the first height, said seating of the top of the central portion in the groove is configured to maintain, when the top tray is stacked on the base tray and the top of the central portion is received in the groove, a vertical gap between a top of the base tray and a bottom of the top tray, the vertical gap having a vertical height sufficient so as to allow access, when the top tray is stacked on the base tray, to any items stored in the food compartment of the base tray;

an outer wall extending from the second base sheet at a distal outer portion of the second base sheet, the outer wall having a second perimeter smaller than the first perimeter;

a plurality of second ribs arranged between the central receiving portion and the outer wall of the top tray to form a food compartment between each of the second ribs for supporting items stored in the food compartment of the top tray;

wherein each second rib defines a respective underside hollow, wherein a top portion of at least a part of each of the ribs in the plurality of first ribs is configured to be received at least partially within the underside hollow of the at least one respective second rib, so as to prevent, when the top tray is stacked on the base tray, rotation of the top tray with respect to the base tray; and a thermoformed first lid configured to mate with the outer lip of the base tray and dimensioned to fully receive the top tray when the top tray is stacked on the base tray.

2. The system of claim 1, wherein the top tray has an outer lip and a second lid is configured to mate with the outer lip of the top tray.

3. The system of claim 2, wherein the second lid is thermoplastic.

4. The system of claim 1, wherein at least one of the first central cavity and the second central cavity is polygonal.

5. The system of claim 1, wherein at least one of the base tray and the top tray is one of polyethylene terephthalate (PET), polypropylene, or polystyrene.

6. The system of claim 1, wherein at least one of the central portion and the central receiving portion is configured to receive a removable tub.

7. The system of claim 1, wherein at least one of the walls forming the central portion, at least one of the walls forming the central receiving portion, at least one of the first ribs, and at least one of the second ribs form sections, and wherein at least one of the first ribs and at least one of the second ribs provide insulation between the respective sections.

8. The system of claim 1, wherein the base tray further comprises a plurality of grooves formed in the first base sheet and arranged between the central portion and the outer wall.

9. The system of claim 1, wherein at least one of the walls forming the central portion, at least one of the walls forming the central receiving portion, at least one of the first ribs, and at least one of the second ribs are configured as channels in a bottom of the respective base tray and top tray.

10. The system of claim 1, wherein the plurality of first ribs radially extend between the central portion and the outer wall of the base tray.

11. The system of claim 10, wherein the plurality of second ribs radially extend between the central receiving portion and the outer wall of the top tray.

12. The system of claim 1, wherein at least one of the first central cavity and the second central cavity is substantially rectangularly-shaped.

13. The system of claim 1, wherein at least one of the first central cavity and the second central cavity is circular or oval.

* * * * *